US005081727A

United States Patent [19]

Ippolito

[11] Patent Number: 5,081,727

[45] Date of Patent: Jan. 21, 1992

[54] ROLL-UP BEACH TOWEL KIT

[76] Inventor: Nicholas W. Ippolito, 36 Gehrig St., Commack, N.Y. 11725

[21] Appl. No.: 739,508

[22] Filed: Aug. 2, 1991

[51] Int. Cl.[5] ..... A47G 9/06

[52] U.S. Cl. ..... 5/419; 5/417

[58] Field of Search ..... 5/417–420, 5/442, 440, 437; 190/1, 2; 383/4

[56] References Cited

U.S. PATENT DOCUMENTS

| | | | |
|---|---|---|---|
| 1,922,485 | 8/1933 | McKee | 150/52 |
| 1,925,358 | 9/1933 | Wittcoff | 5/419 |
| 3,689,947 | 9/1972 | Wolf | 5/419 |
| 4,195,378 | 4/1980 | Parker | 5/419 |
| 4,222,468 | 9/1980 | De Fries | 5/431 |
| 4,546,507 | 10/1985 | Weinstein | 5/419 |
| 4,980,935 | 1/1991 | Kazanowski et al. | 5/419 |
| 4,991,245 | 2/1991 | Franco | 5/419 |
| 5,022,107 | 6/1991 | Knotts | 5/419 |

FOREIGN PATENT DOCUMENTS

| | | | |
|---|---|---|---|
| 761135 | 1/1934 | France | 5/419 |
| 2539969 | 3/1983 | France | 5/419 |

*Primary Examiner*—Alexander Grosz

[57] ABSTRACT

A beach kit comprising a hollow, generally cylindrical, insulating foam pillow defining an insulating container having hinged covers at its ends, and a generally rectangular towel portion having at one of its ends holes adapted to accommodate anchoring stakes, the opposite end of the towel portion comprising a band of elastic material, said opposite end of the towel portion being folded over and secured to the towel body to define a loop portion of a diameter smaller than the diameter of the pillow so that the loop portion may be stretched and snugly and removably secured to the pillow by said loop, adapted to be rolled around and retained on the pillow.

4 Claims, 1 Drawing Sheet

ROLL-UP BEACH TOWEL KIT

FIELD OF THE INVENTION

A new beach kit concept utilizing a foam tube that can be used as a head rest, storage compartment and easy, beach towel roll-up, for carrying. This kit comes equipped with two stakes that are passed through two grommet holes, located in one end of the towel, that allow towel to be secure, tight and taut to the beach. The object of this invention is to provide to the individual beach goer the most practical, simple and enjoyable package that can be made available at an economically reasonable price.

DESCRIPTION OF THE PRIOR ART

There have been other patents that have been granted for beach kits in many varieties. There is Weinstein U.S. Pat. No. 4,546,507, Storie U.S. Pat. No. 2,898,607 and possibly others.

Weinstein has the inflatable pillow that is separate from the beach towel and has to be connected thereto. Upon leaving the beach both pieces have to then be folded into a carrying pack.

Storie has something similar to Weinstein. His is made in 1 piece with two inflatable pillows and fold into a carrying case.

Although these beach combinations are useful and do provide certain advantages for particular purposes, mainly that of enhancing an outing at the beach, the present invention goes one step beyond, as will be described in this literature.

SUMMARY OF INVENTION

The invention of the roll-up beach towel kit relieves the beach goer from the problem of inflating an object to achieve a head rest. She or he simply places the tube on the beach, pushes the tube to roll out the beach towel. Then two stakes are removed from the tube storage compartment. The stakes are inserted through the two grommet holes provides, and the stakes are then pressed into the sand.

The storage compartment is large enough to accept standard size beer and soda cans, and because tube is made of insulation foam, the cans can be kept cold for a certain amount of time. The compartment may also be used to store other valuables while bather is in swimming.

Upon completion of a day at the beach, bather simply pulls the two stakes, from the sand and returns them to the storage compartment. Bather then grips each end of the tube, shakes sand from the towel, then procedes to roll up beach towel. On the last roll, two handles conveniently come together as do a number of hook and loop type fasteners such as the ones sold under the Trademark of VELCRO. Securing the towel in position, the bather simply grabs the handles of the tube roll-up beach towel, and departs for the day.

If bather decides to launder towel, the towel is designed to slip off the tube. Upon completion of laundering the towel is easily stretched and slipped over slightly larger tube diameter. Tube roll-out beach towel is ready to engage beach again.

DETAILED DESCRIPTION OF DRAWINGS

Figure 1:
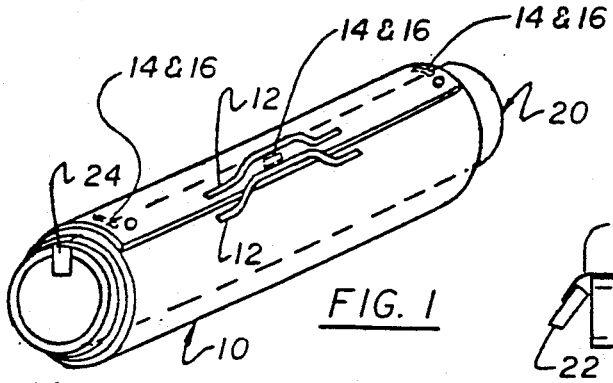
FIG. 1, is a perspective view of beach towel in roll-up condition.

Turning now descriptively to the drawings in which similar reference characters denote similar elements throughout the several views. Also let it be known that the views of drawings are approximate and not to scale.

FIG. 1 shows the beach towel 10 rolled around the tube 20. The towel 10 is rolled about the tube 20 completely, on the final wrap, hook and loop type patches 14 meet hook and loop type patches 16, keeping towel 10 secured in a roll-up condition. At the same time, two fabric handles 12 come together to form a convenient carrying handle 12. The hook and loop type patches 14 and 16 are sewn on as shown.

Figure 2:
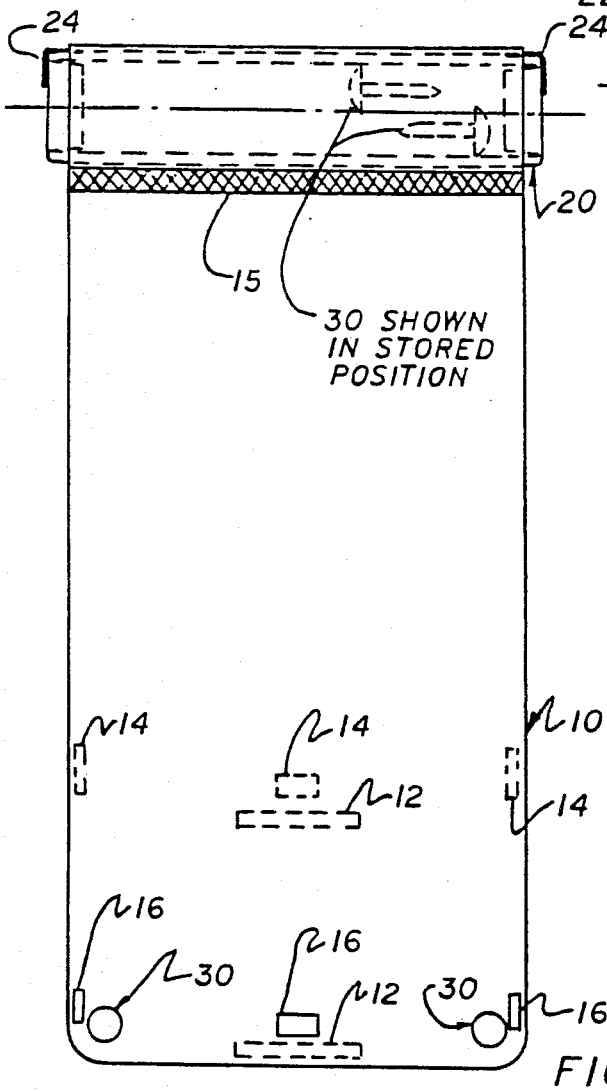
FIG. 2 is top view of beach towel as it appears when used at the beach.

FIG. 2 shows beach towel 20 deployed at the beach. When extended completely two anchor stakes 30 are inserted through two grommet holes **13*a* and 13*b*** into beach sand.

Figure 3:
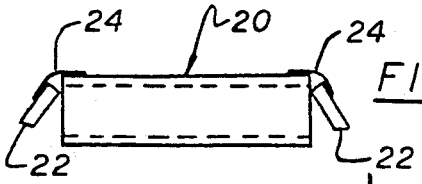
FIG. 3 shows tube only, with hinged covers on both sides.

FIG. 3 details foam tube 20 showing a hinged cover 22 on each end of the tube 20 attached, with two hinges 24 that could be made of plastic or any other reasonable substitute. The tube 20 will have a diameter that is not so large as to be cumbersome for storing, and carrying, but large enough to be restful when laying one's head on it, at the beach.

Figure 4:
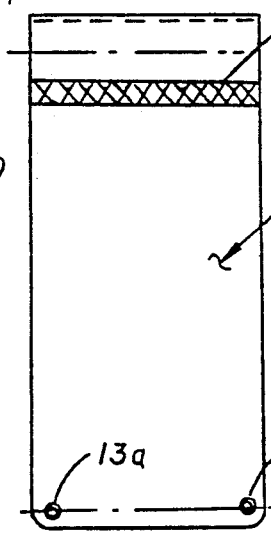
FIG. 4 shows top plan view of towel only, with elastic strip and two grommet holes.

FIG. 4 shows a top view of towel 10 only. The towel is folded over about 5 inches. Then a band of elastic material 15 is sewn across width of towel. The diameter of this loop is designed to be smaller than the outside diameter of the foam tube 20. Therefore, when the towel 10 is placed over the tube 20, it must be stretched over into a snug position. At the other end of the towel 10 are two grommet holes **13*a* and 13*b*. They are located in the corner to accept two anchor stakes 30. This FIG. 4 does not show the hook and loop type patches that are better shown in detail on FIG. 2**.

Figure 5:
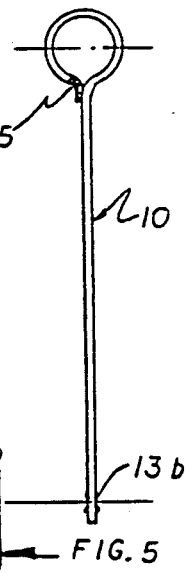
FIG. 5 shows end view of FIG. 4.

FIG. 5 simply shows the towel in an end position showing how the loop is formed so that it may be placed over the tube 20.

Figure 6:
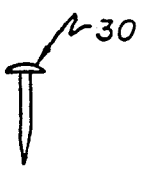
FIG. 6 shows shape of anchor stake.

FIG. 6 shows approximate shape of anchor stakes 30. Length of stake 30 is about 7 inches long, and has a mushroom head at one end about 3 inches in diameter. Stake 30 is made of plastic.

A beach kit solely designed for the individual beachgoer. The main thrust of this invention is the foam tube and its unique application. The size of the tube is approximately three feet in length. The outside diameter of the tube is about six inches, and the inside diameter is about four inches.

I claim:

1. A beach kit comprising a hollow, generally cylindrical, insulating foam pillow defining an insulating container having hinged covers at its ends, and a generally rectangular towel portion having at one of its ends holes adapted to accommodate anchoring stakes, the opposite end of the towel portion comprising a band of elastic material, said opposite end of the towel portion being folded over and secured to the towel body to define a loop portion of a diameter smaller than the diameter of the pillow so that the loop portion may be stretched and snugly and removably secured to the pillow, the towel, when secured to the pillow by said loop, adapted to be rolled around and retained on the pillow.

2. The beach kit of claim 1, further comprising hook and loop type fasteners attached to the towel, to retain the towel in a rolled up condition on the pillow.

3. The beach kit of claim 1, further comprising handles on the towel portion.

4. The beach kit of claim 1, further comprising anchoring stakes housed in the container defined by the pillow.

* * * * *